United States Patent [19]

Murray et al.

[11] 4,008,040

[45] Feb. 15, 1977

[54] PHOTOFLASH LAMP AND METHOD OF MAKING SAME

[75] Inventors: Donald E. Murray, Montoursville; Daniel W. Bricker, Williamsport, both of Pa.

[73] Assignee: GTE Sylvania Incorporated, Montoursville, Pa.

[22] Filed: Nov. 24, 1975

[21] Appl. No.: 634,991

[52] U.S. Cl. ..... 431/94; 431/95 R

[51] Int. Cl.[2] ..... F21K 5/02

[58] Field of Search ..... 431/94, 95 R

[56] References Cited

UNITED STATES PATENTS

| | | | |
|---|---|---|---|
| 3,816,054 | 6/1974 | Baldrige et al. | 431/95 R |
| 3,872,560 | 3/1975 | Bock | 431/95 R X |
| 3,873,260 | 3/1975 | Cote | 431/95 R |
| 3,873,261 | 3/1975 | Cote | 431/95 R |
| 3,884,615 | 5/1975 | Sobieski | 431/95 R |

*Primary Examiner*—Alan Cohan
*Assistant Examiner*—Gerald A. Michalsky
*Attorney, Agent, or Firm*—Edward J. Coleman

[57] ABSTRACT

A high-voltage type photoflash lamp filled with a filamentary combustible material and oxygen and having an ignition structure comprising a pair of spaced apart lead-in wires bridged at their inner ends by a mass of primer material. An insulating sleeve encloses one of the wires, with the inner end of that wire and the top of the sleeve having a melted down configuration with a smooth and rounded surface. The other lead-in wire lies outside the sleeve and is formed to terminate and make contact with the exterior of the sleeve at or near its top end. The primer material is disposed to cover the top end of the sleeve and bridge the ends of the lead-in wires. Also disclosed is a method of making the lamp including the step of applying a flame to melt down a protruding end of the sleeve lead-in wire prior to sealing the ignition mount into the glass tubing to be formed into the lamp envelope.

9 Claims, 5 Drawing Figures

PHOTOFLASH LAMP AND METHOD OF MAKING SAME

BACKGROUND OF THE INVENTION

This invention relates to photoflash lamps and, more particularly, to flashlamps of the type containing a primer bridge ignited by a high voltage pulse.

High voltage flashlamps may be divided historically into three categories: (1) those having a spark gap within the lamp such that electrical breakdown of a gaseous dielectric (e.g., the combustion-supporting oxygen atmosphere) is an integral part of the lamp ignition mechanism; (2) those having a conductive primer bridge that electrically completes the circuit between the lead-in wires; such primers are rendered conductive by additives such as acetylene black, lead dioxide, or other electrical conduction-promoting agents; and (3) lamps having an essentially nonconducting primer bridge that connects the inner ends of the lead-in wires and which becomes conductive, upon application of a high voltage pulse, by means of breakdown of the dielectric binder separating conductive particles therein.

The earliest high voltage flashlamps were of the spark gap type construction wherein an electrical spark would pass through the gaseous atmosphere within the lamp. The spark would jump between two electrodes, at least one of which was coated with a primer composition. Such lamps tend to exhibit poor sensitivity and reliability when flashed from low power sources such as the miniaturized piezoelectric devices that are suited for incorporating into pocket-sized cameras. Most of the electrical input energy in such lamps is lost to the gas atmosphere by the spark. Also, the electrical characteristics vary considerably from one lamp to another because of shreds of metallic combustible in the spark gap and consequent variations in effective gap length.

The use of spaced lead-in wires interconnected by a quantity of electrically conductive primer gives rise to highly predictable behavior and a well-defined electrical path through the lamp. Here again, however, relatively highpowered flash sources must be used in order to attain reliable lamp flashing.

Present state of the art flashlamps of the high voltage type make use of a bridge of initially nonconducting primer to interconnect the inner ends of the lead-in wires. Considerably higher sensitivity is attainable by this method, apparently because the breakdown and discharge follow a discrete path through the primer composition and thereby promote greater localized heating. With respect to specific construction, such flashlamps typically comprise a tubular glass envelope constricted and tipped off at one end and closed at the other end by a press seal. A pair of lead-in wires pass through the glass press and terminate in an ignition structure including a glass bead, one or more glass sleeves, or a glass reservoir of some type. A mass of primer material contained on the bead, sleeve or reservoir bridges across and contacts the ends of the lead-in wires. Also disposed within the lamp envelope is a quantity of filamentary metallic combustible, such as shredded zirconium or hafnium foil, and a combustion-supporting gas, such as oxygen, at an initial fill pressure of several atmospheres.

Lamp functioning is initiated by application of a high voltage pulse (e.g., several hundred to several thousand volts, as for example, from a piezoelectric crystal) across the lamp lead-in wires. The mass of primer within the lamp then breaks down electrically and ignites; its deflagration, in turn, ignites the shredded combustible which burns actinically.

The fabrication and testing of a number of different ignition structures has shown several problem areas that are peculiar to high voltage type flashlamps, and which are familiar to those skilled in the art of flashlamp design. For example, random location of the shreds of metallic combustible can cause short circuiting of the lead-in wires or interfere with the intended electrical breakdown path through the primer. Post-flash short circuiting can be caused by primer residue, metallic or semimetallic droplets of slag from the ignited shreds of combustible, and possible welding of the lead-in wires after ignition.

An example of a prior art lamp structure directed to overcoming some of those problems is described in U.S. Pat. No. 3,875,260 of Cote wherein one of the lead-in wires of the ignition mount is recessed in a glass insulating sleeve which is sealed to the press at one end and open at the other end. The other lead-in wire is formed so that it rests against and terminates slightly above the open end of the sleeve. The mass of primer material is disposed to cover the open end of the sleeve and bridge the ends of the lead-in wires. The glass sleeve has a side vent opening for the purpose of avoiding air entrapment during primer application to assure the primer material reaches the sleeved lead. Such a vent hole, however, introduces a degree of added cost and exposes the sleeved lead-in wire to a possible shred shorting condition. Consequently, an alternative approach that has been employed is to use a continuous sleeve, with no vent hole. But this last-mentioned mount design also has some apparent shortcomings. The fact that the sleeved lead-in wire is recessed causes problems with primer bridging. It is necessary to use air pressure to force primer into the glass sleeve to contact the lead. This method consists of a seal connecting the top edge of the primered bottles and using the same seal as a means to force primer into the sleeve. Poor sealing of the bottle caused by a slight chip in the glass, worn or torn sealing edge, etc., can cause splashed primer and primer not contacting the lead in the sleeve. Another criticism of the prior construction is the possibility of shreds getting into the sleeve opening. Since the primer is being forced into the sleeve, an opening can appear in the primer, enhancing the possibilities of shred shorts.

Another prior art lamp structure of interest is described in U.S. Pat. No. 3,884,615 of Sobieski wherein the two lead-in wires of the ignition mount are sealed into a doughnut-shaped glass bead which is open at both ends. The central opening in the bead is filled with a mass of primer material which bridges the lead-in wires. This construction uses the bead as a shield to keep the combustible fill away from the bare lead wire below the bead. The bead obviously must be smaller than the inside diameter of the lamp envelope. However, this creates a space for strands of fill to slip past the bead and come in contact with the lead wires, thereby shorting out the system and rendering the lamp inoperable. The close proximity of the bead and lamp envelope requires precise mount placement in order to prevent the bead from being sealed into the lamp envelope, thus weakening the final product. The Sobieski patent does disclose alternatives to counter the shred short problem, such as the use of a sleeve below the bead or special bead shaping, but such designs add to the cost of a bead structure, which is in itself comparatively expensive, and introduce additional manufacturing problems.

SUMMARY OF THE INVENTION

In view of the foregoing, it is an object of this invention to provide an improved photoflash lamp with a more reliable ignition means.

Another object is to provide an improved ignition structure in a high-voltage type flashlamp which assures more consistent primer application and thus improved control of the manner and quantity of primer material applied.

A further object is to provide a high-voltage type flashlamp having an ignition structure with improved resistance to shred-fill shorts prior to flashing.

Yet another object is to provide a high voltage type flashlamp which may be economically produced with comparative ease in a high volume manufacturing process.

Still another object of the invention is to provide an improved method for making a photoflash lamp.

These and other object advantages and features are attained in an ignition structure having a first lead-in wire within an insulating sleeve and a second lead-in wire disposed outside the sleeve and terminating at or near the end of the sleeve to which primer material is applied. In accordance with the principles of this invention, the termination of the first lead-in wire, at the primer end of the sleeve, has a melted down configuration. In this manner, the first lead-in wire is protected but not to the point of being unaccessible to the primer. The smooth surface at the melted down end of the structure yields a primer coating that is uniform and thick enough to protect the mount against shred-fill shorts. No corners or sharp edges are present to protrude through the primer coating. The structure also permits a more consistent and efficient primer application, with a reduction in the weight of the primer material required.

The method of making the lamp is particularly well adapted to high volume manufacturing and includes the steps of inserting an insulating sleeve over the top portion of a first lead-in wire with the end of the wire protruding above the end of the sleeve, then applying a flame to the protruding end of the first lead-in wire to melt the wire down at the top of the sleeve.

BRIEF DESCRIPTION OF THE DRAWING

This invention will be more fully described hereinafter in conjunction with the accompanying drawings, in which.

DESCRIPTION OF PREFERRED EMBODIMENT

Figure 1:
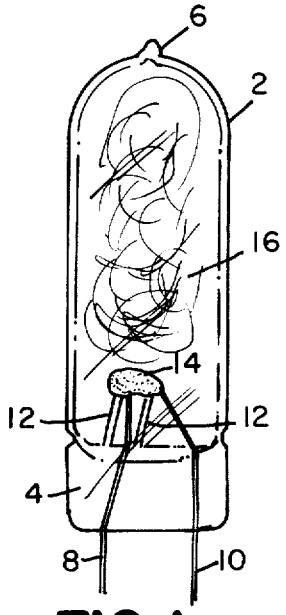
FIG. 1 is an elevational view of a photoflash lamp in accordance with the invention.
Figure 2:
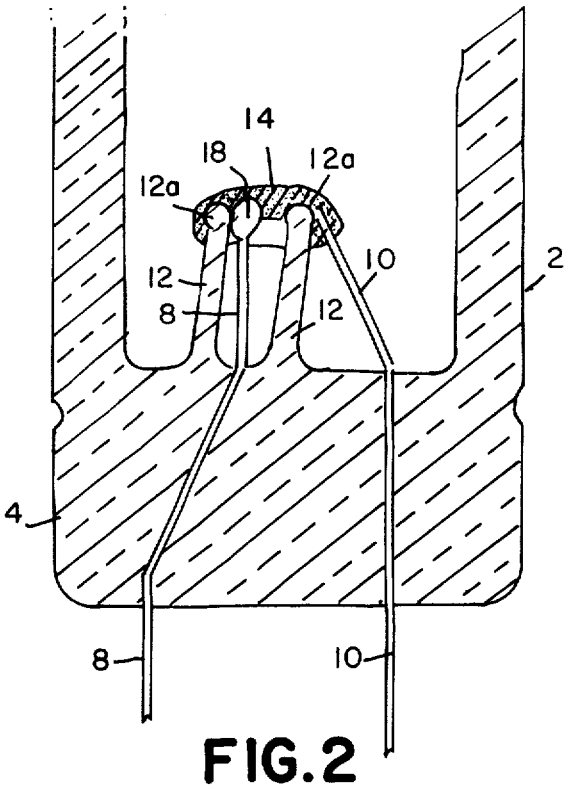
FIG. 2 is a fragmentary vertical sectional view on an enlarged scale of the inlead and ignition means construction of the lamp of FIG. 1.

Referring to FIGS. 1 and 2, the high-voltage type flashlamp illustrated therein comprises an hermetically sealed light-transmitting envelope 2 of glass tubing having a press 4 defining one end thereof and an exhaust tip 6 defining the other end thereof. Supported by the press 4 is an ignition means comprising a pair of lead-in wires 8 and 10 extending through and sealed into the press, an insulating sleeve 12 extending within the envelope about lead-in wire 8, and a mass of primer material 14 bridging the end portions, or terminations, of the lead-in wires within the envelope. The insulating sleeve 12 may be formed of glass or ceramic and is preferably sealed into the envelope press 4 at one end so that only the inward end of the sleeve is open. It will be noted that the sleeve 12 has no side vent hole.

In accordance with the invention, the termination 18 of lead-in wire 8 has a melted down configuration with a smooth and rounded surface at the open end of the sleeve 12. Additionally, the open end of the sleeve may have a melted down configuration with smooth and rounded surfaces at areas 12*a*. Lead-in wire 10 is disposed outside of sleeve 12 and formed to make contact with and terminate at or near the open end of sleeve 12, as shown. The mass of primer material 14 is applied so as to substantially cover the open end of sleeve 12 and bridge the terminations of the lead-in wires.

Typically, the lamp envelope 2 has an internal diameter of less than ½ inch and an internal volume of less than 1 cc. A quantity of filamentary combustible fill material 16, such as shredded zirconium or hafnium foil, is disposed within the lamp envelope. The envelope 2 is also provided with a filling of combustion-supporting gas such as oxygen, in an amount in excess of the quantity required for stoichiometric chemical reaction with the combustible material 16; preferably above four atmospheres. More specifically, the excess of fill gas is sufficient so that, upon flashing of the lamp, the combustible material 16 is completely consumed and the unsleeved lead-in wire 10 within the lamp is sufficiently burned back away from sleeve 12 so as to eliminate any chance of post-flash short circuiting. The length of the external surface of the sleeve 12 renders innocuous the effect of any shred droplets that adhere thereto.

The use of excess oxygen in a flashlamp to assure the burning back of inleads for providing an open circuit after flashing is described in copending application Ser. No. 508,959, filed Sept. 25, 1974 and assigned to the present assignee.

Typically the exterior surface of the glass envelope 2 is also provided with a protective lacquer coating, such as cellulose acetate (not shown).

Figure 4:
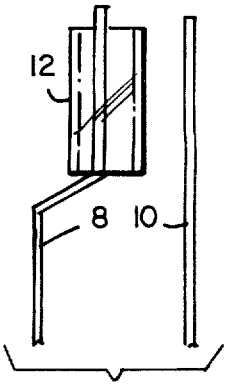
FIG. 4 is an enlarged fragmentary elevation illustrating the step of inserting an insulating sleeve on the top portion of one of the two lead-in wires.
Figure 5:
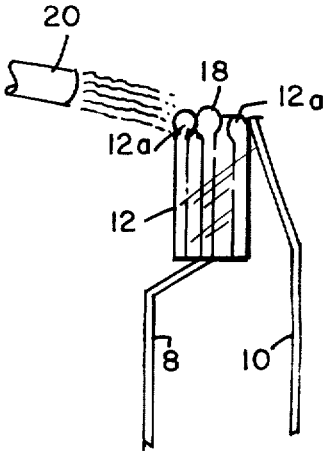
FIG. 5 is an enlarged fragmentary elevation illustrating the step of applying a flame to melt down the protruding end of the sleeved lead-in wire; this Figure also shows the unsleeved lead-in wire bent over to contact the top edge of the sleeve, but this step preferably is performed subsequent to flame application.

A preferred method of making a photoflash lamp according to the invention comprises the following steps. First, providing lead-in wires 8 and 10 and shaping the upper portion of lead-in wire 8 as shown in FIG. 4. The insulating sleeve 12 is then inserted over the top portion of the lead-in wire 8, with the end of wire 8 protruding above the top end of sleeve 12, as illustrated. Preferably, the end of wire 8 protrudes from about 0.035 to 0.045 inch above the top end of the sleeve. Next, referring to FIG. 5, a flame from a source 20 is applied to the protruding end of lead-in wire 8 to cause that protruding end of wire to melt and provide a smooth rounded surface of wire (termination 18) at the top of the sleeve. In addition, the flame may also be applied to the top end of the sleeve 12, as shown, so that the open end of the sleeve has a melted down configuration with smooth and rounded surfaces at areas 12*a*. After this structure is removed from the flame, lead-in wire 10 is formed, as shown in FIG. 5, to terminate and make contact with the exterior surface of sleeve 12 at or near the top end thereof. It is preferred that wire 10 remain remote from sleeve 12, e.g., as shown in FIG. 4, until after flame application so as to avoid undesired melting down of external wire 10. The lead-in wires and one end of sleeve 12 are then sealed into one end of a length of glass envelope tubing at the press 4. A quantity of primer material is dip-applied so as to provide the mass 14 bridging the top ends of the lead-in wires within the envelope tubing. The envelope tubing is then filled with a quantity of filamentary combustible material 16, such as shredded zirconium, and a combustion-supporting gas, such as oxygen. The open end of the tubing is then constricted and tipped off at 6 to provide an hermetically sealed envelope 2. A protective lacquer coating is then applied to the exterior of the glass envelope, such as by dipping and drying.

Figure 3:
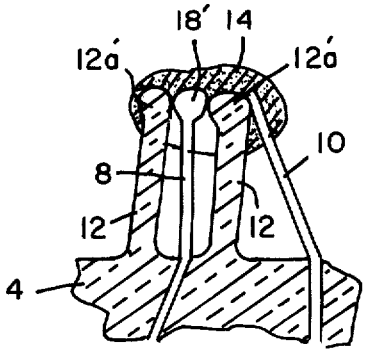
FIG. 3 is a fragmentary vertical sectional view on an enlarged scale of an alternative inlead and ignition means construction.

FIGS. 2 and 5 illustrate an ignition mount structure with an opening at the end of the sleeve covered by primer material; this allows primer to better contact wire 8 by seeping into the sleeve opening. An alternative embodiment is illustrated in FIG. 3, wherein the flame application step causes the protruding end of the wire 8 and the top end of the sleeve to melt down in a configuration which closes the top end of the sleeve and forms a smooth rounded surface of wire and sleeve insulating material, such as glass, at the top end of the sleeve. In this instance, the melted down lead-in wire termination is denoted as 18' and the melted sleeve portions are designated 12*a'*. An advantage of such a closed-sleeve configuration (FIG. 3) is that it eliminates a possible cause of a primer opening which could lead to a shred short.

Operation of such high voltage flashlamps is initiated when a high voltage pulse from, e.g., a piezoelectric crystal, is applied across the two lead-in wires 8 and 10. Electrical breakdown of the primer causes its deflagration which, in turn, ignites the shredded metallic combustible 16.

The advantages of the improved ignition structure design described above include: a more consistent primer application; a primer weight reduction; a highly reliable lamp; and a lamp that can be produced with relative ease. Lead-in wire 8 is protected but not to the point of being inaccessible to the primer. By melting the lead-in wire in the sleeve, a smooth surface is obtained which yields a primer coating that is uniform and also thick enough to protect the mount against fill shorts. No corners or sharp edges are present to protrude through the primer coating.

By way of example only, a group of 1000 lamps of the construction shown in FIG. 1 was prepared. The lamps were fabricated from type 7052 glass tubing of 0.259 inch O.D. The internal volume was 0.35 $cm^3$; the quantity of filamentary combustible material was 14.5 mgs. of 4 inches-long zirconium shreds having a cross section of 0.00093 × 0.0012 inch; the oxygen fill pressure was 1220 cm. Hg. absolute. The lead-in wires 8 and 10 were 0.014 inch diameter Rodar; the insulating sleeve 12 was 0.160 inch long, type 7052 glass having an O.D. of 0.060 inch and an I.D. of 0.030 inch. Approximately 1.5 mgs. of primer 14 was used for each lamp; the primer comprised 99.0 per cent by weight of zirconium powder and 1.0 per cent by weight cellulose nitrite on a dried basis. An exterior coating of cellulose acetate lacquer was provided. The lamps were flashed from a piezoelectric source having a 75 microjoule, 2000 volt output pulse. All lamps flashed reliably with no post-flash short circuiting evidenced.

Although the invention has been described with respect to a specific embodiment, it will be appreciated that modifications and changes may be made by those skilled in the art without departing from the true spirit and scope of the invention.

What we claim is:

1. A photoflash lamp comprising:

an hermetically sealed, light-transmitting envelope;

a quantity of filamentary combustible material located within said envelope;

a combustion-supporting gas in said envelope;

and ignition means disposed in said envelope in operative relationship with respect to said combustible fill material, said ignition means including first and second lead-in wires extending into said envelope in a spaced relationship, a sleeve of insulating material extending within said envelope about said first lead-in wire, said sleeve being sealed to said envelope at one end and being proximate the termination of said first lead-in wire within said envelope at the other end, said termination of the first lead-in wire having a melted down configuration with a smooth and rounded surface at said other end of the sleeve, said second lead-in wire being outside of said sleeve and terminating at or near said other end of the sleeve, and a mass of primer material disposed to substantially cover said other end of the sleeve and bridge the terminations of said lead-in wires.

2. The lamp of claim 1 wherein said other end of said sleeve of insulating material has a melted down configuration with a smooth and rounded surface.

3. The lamp of claim 2 wherein said sleeve is glass and the melted down configurations of said first lead-in wire termination and said other end of the glass sleeve close said melted down end of the sleeve and form a smooth rounded surface of wire and glass.

4. The lamp of claim 2 wherein said other end of said sleeve is open, and said mass of primer material is disposed to cover the open end of said sleeve and bridge the termination of said lead-in wires.

5. The lamp of claim 1 wherein said combustion-supporting gas in said envelope is oxygen at an initial fill pressure exceeding about four atmospheres.

6. The lamp of claim 1 wherein said combustion-supporting gas in said envelope is an amount in excess of the quantity required for stoichiometric chemical reaction with said filamentary combustible material whereby, upon flashing of the lamp, said filamentary combustible material is consumed and said second lead-in wire is sufficiently burned back to prevent post-flash short circuiting of the lamp.

7. A method of making a photoflash lamp comprising:

inserting an insulating sleeve over the top portion of a first lead-in wire with the end of the wire protruding above the top end of the sleeve;

applying a flame to the protruding end of said first lead-in wire to cause said protruding end of wire to melt and provide a smooth, rounded surface of wire at the top end of the sleeve;

forming a second lead-in wire to terminate and make contact with the exterior surface of said sleeve at or near the top end thereof;

sealing said lead-in wires and the bottom end of said sleeve into one end of a length of glass tubing;

bridging the top ends of said lead-in wires within said glass tubing with primer material;

filling said glass tubing with a quantity of filamentary combustible material and a combustion-supporting gas;

tipping off the tubing to provide an hermetically sealed envelope and applying a protective coating on the exterior of said envelope.

8. The method of claim 7 wherein the end of the first lead-in wire protrudes from about 0.035 to 0.045 inch above the top end of said sleeve after said sleeve insertion step and before said flame application step.

9. The method of claim 7 wherein said flame application step comprises applying a flame to the top ends of both said sleeve and said first lead-in wire to cause the protruding end of the wire and the top end of the sleeve to melt and provide a smooth, rounded surface of wire and insulating sleeve material at the top end of the sleeve.

* * * * *